United States Patent [19]

Bianchi et al.

[11] Patent Number: 4,526,666

[45] Date of Patent: Jul. 2, 1985

[54] METHOD FOR ELECTRICALLY CONNECTING NON CORRODIBLE ANODES TO THE CORRODIBLE CORE OF A POWER SUPPLY CABLE

[75] Inventors: Guiseppe Bianchi, Milan; Gian L. Mussinelli, Como, both of Italy

[73] Assignee: Oronzio de Nora, Lugano, Switzerland

[21] Appl. No.: 511,399

[22] Filed: Jul. 7, 1983

Related U.S. Application Data

[63] Continuation-in-part of Ser. No. 452,268, Dec. 22, 1982, Pat. No. 4,452,683.

[30] Foreign Application Priority Data

Jun. 23, 1983 [IT] Italy ..... 21754 A/83

[51] Int. Cl.[3] ..... C23F 13/00

[52] U.S. Cl. ..... 204/196; 204/290 F; 72/402; 174/84 C; 29/825; 29/863; 29/867; 29/871

[58] Field of Search ..... 204/147, 148, 196, 197, 204/290 F; 174/84 C, 90; 72/402; 29/825, 867, 863, 871

[56] References Cited

U.S. PATENT DOCUMENTS

| | | | |
|---|---|---|---|
| 2,876,190 | 3/1959 | Oliver | 204/196 |
| 2,982,808 | 5/1961 | Schwester | 174/84 C |
| 3,098,027 | 7/1963 | Flower | 204/196 |
| 3,150,233 | 9/1964 | Dinger | 174/84 C |
| 3,251,427 | 5/1966 | Ewing | 204/197 |
| 3,326,791 | 6/1967 | Heuze | 204/196 |
| 3,527,685 | 9/1971 | Anderson | 204/196 |
| 3,616,418 | 10/1971 | Anderson et al. | 204/196 |
| 4,170,532 | 10/1979 | Tatum | 204/196 |
| 4,267,029 | 5/1981 | Massarsky | 204/196 |
| 4,268,957 | 5/1981 | Sbuelz | 29/871 |

FOREIGN PATENT DOCUMENTS

| | | | |
|---|---|---|---|
| 1110983 | 7/1961 | Fed. Rep. of Germany | 204/196 |

*Primary Examiner*—T. Tung

*Attorney, Agent, or Firm*—Pollock, Vande Sande & Priddy

[57] ABSTRACT

The invention relates to an improved method to connect one or more non corrodible, valve metal anodes whose surface has been activated by a deposit of non passivatable material, to a power supply cable, insulated by a sheath of rubber or other elastomeric material, to make flexible anode assemblies to be used for the cathodic protection of metallic structures, either in water or soil environments.

Each anode is provided with a valve metal sleeve, which may be inserted along the cable and then swaged first directly onto the cable's conducting core, previously stripped of its insulating sheath, in correspondence of the central portion of the sleeve, and subsequently swaged at the two ends directly onto the insulating sheath of the cable. Bushes of a ductile metal or alloy, preferably anodically dissoluble, are disposed onto the valve metal sleeve before swaging, in order to take up the wrinkling and allow a more uniform circumferential reduction of the valve metal sleeve over the cable.

2 Claims, 5 Drawing Figures

METHOD FOR ELECTRICALLY CONNECTING NON CORRODIBLE ANODES TO THE CORRODIBLE CORE OF A POWER SUPPLY CABLE

CROSS REFERENCE TO RELATED APPLICATIONS

The present application is a continution-in-part of copending U.S. Application Ser. No. 452,268, filed on Dec. 22, 1982, now U.S. Pat. No. 4,452,683, and entitled "Anodic Structure For Cathodic Protection".

BACKGROUND OF THE INVENTION

The present invention concerns a method for providing a sealed electrical connection of non corrodible anodes to the corrodible conductive core of a power supply cable.

The anodes used for the cathodic protection of buried or immersed metal structures, by the impressed current system, often need to be placed at a great distance from the surface of the structure to be protected, in order to ensure the best uniformity of current distribution over the structure itself.

Therefore, the electric current must be led to the anodes by electric cables exhibiting a low ohmic drop, such as insulated copper or aluminum cables. Said highly conductive metals, however, readily undergo anodic dissolution, if they come in contact with the medium, either water or soil, wherein the anodes operate.

The introduction of permanent anodes, that is anodes made of materials resistant to anodic corrosion and dissolution, represents a considerable technological improvement as these anodes offer a practically unlimited performance, or, in any case, a much longer life than the so called sacrificial anodes, which, being anodically dissolved, although offering more or less extended periods of operation, are always bound to be periodically renewed.

The new permanent anodes are usually constituted by a valve metal base, such as titanium, tantalum, niobium, hafnium, tungsten or zirconium or alloys thereof.

The anodes surface is, at least partially, coated with a layer of a material resistant to corrosion and anodically non passivatable, such as a noble metal belonging to the platinum group, such as platinum, iridium, rhodium, ruthenium, palladium, osmium or more preferably an oxide thereof, in single form or in admixture with other materials, or constituting mixed crystal with oxides of valve metals or of other metals, preferably other transition metals.

With the advent of the new permanent anodes, which afford extremely long periods of operation, it has become of paramount importance to ensure that all the parts constituting the anode structure conform to the same characteristics of reliability and durability.

In particular, the main requirement to be met is to provide a suitable electric connection to the power supply cable, long lasting and absolutely protected from contact with the medium wherein the anodic structure is operating.

Various solutions have been proposed. Among these, U.S. Pat. No. 3,134,731 illustrates a system of connection which utilizes stuffing boxes and sealing putty. U.S. Pat. No. 2,841,413 describes a connecting method utilizing a sleeve welded at one end of the anode, the conducting strands of the power supply cable being inserted into said sleeve which is then squeezed onto the strands. The electrical connection is protected by means of an impermeable adhesive tape.

However, by utilizing auxiliary sealing materials, a perfect reproducibility and reliability of the sealing is not always achieved. Moreover, the materials used to seal the connection tend to loose their properties and efficacy with time and the performance of the anodic structure often depends on the effective life of said auxiliary means.

OBJECTS OF THE INVENTION

The present invention has the purpose to provide for a method which is simple to carry out and enables to prepare long lasting and highly reliable leak-proof connections with exceptional characteristics of reproducibility without the need to resort to stuffing boxes, sealing tapes or other auxiliary sealing materials.

GENERAL AND DETAILED DESCRIPTION OF THE INVENTION

The method of the present invention is particularly suited to connect one or more anodes placed and fixed at intervals along an insulated power supply cable passing coaxially through the anode or the various anodes without interruptions and which acts both as the supporting element as well as the current conducting means to the anode or anodes.

The cable is flexible and is made of plaited or stranded wires of a conducting metal such as copper or tinned copper, or aluminum and/or steel.

The cable is provided with one or more superimposed sheaths made of insulting elastomeric material resistant to the medium of utilization of the anode, such as ethylpropylene rubber (EPR) or chlorinated polysulphonated polyethylene (HYPALON$^{(R)}$), produced by Du Pont de Nemours.

The anode, or each anode, is essentially constituted by a tube or sleeve made of a valve metal, having an internal diameter slightly larger, that is from about 1 to about 6 mm, than the external diameter of the insulated cable.

According to the method of the present invention, the insulating sheath of the cable is stripped off for a certain portion, which may be comprised between 1 cm and about 4 cm, in correspondence of the points where to the anode is intended to be fixed.

The two halves of a split collar, made of copper, tinned copper, or aluminum, and having substantially the same length of the stripped portion and substantially the same thickness of the sheath insulating the conducting core of the cable, are thence disposed around the bare conductive core.

A cylinder or bush, made or ductile metal, such as copper, aluminum, iron, cuprous-nickel alloy or valve metal is inserted over the tube or sleeve of the valve metal anode in correspondence of the fixing point. The bush may have a wall thickness comprised between 1 and 10 millimeters and a length substantially identical to the length of the split collr inserted onto the cable conducting core inside the tubular anode.

Fixing is carried out by inserting the assembly thus prepared into a segmented circular die of a swaging press and closing the die onto the external bush thus swaging (cold-heading) the valve metal tube onto the split collar and onto the conductive core of the power supply cable.

The external ductile bush undergoes the unavoidable superficial wrinkling caused by the impressions of the segmented circular swaging die and allows a more uniform circumferential reduction, without any substantial wrinkling of the underlying valve metal tube which is plastically squeezed onto the two halves of the copper or aluminum collar, which in turn are plastically squeezed onto the conducting core of the power supply cable, thus providing for the electrical connection of the valve metal anode tube to the power supply cable.

The sealing of the electrical connection is achieved by placing two bushes of the same type of the one used for the electrical connection near the two ends of the tubular anode and then repeating the swaging procedure onto the two bushes. The valve metal tube is plastically squeezed directly onto the elastomeric insulating sheath of the power supply cable, thus ensuring a perfect hydraulic sealing with no need to resort to any auxiliary sealing means.

Also in this case, a uniform plastic circumferential reduction of the valve metal tube over the elastomeric sheath is achieved without giving rise to any perceptible wrinkling of the valve metal tube itself, which could cause micro-cracking of the valve metal constituting the anode or expose the valve metal to possible localized stress corrosion.

Moreover, the exceptionally uniform circumferential reduction of the valve metal tube underneath the ductile bush avoids pinching of the underlying insulating sheath which, otherwise, could give rise to defects of the hydraulic sealing.

The external ductile bushes may be removed when the assembly procedure is terminated, for example with the aid of a burr mill, or they may be left in place.

The bushes may also be constituted by a valve metal, resistant to anodic dissolution, but more preferably they are made of anodically dissoluble materials, such as copper, aluminum, iron (ARMCO iron) or cuprous-nickel alloys. In this case, they are conveniently left in place and become an integral part of the anode, being anodically dissolved during the initial operation period. This turns out to be an important advantage as the anodic dissolution of the external bushes helps the permanent coated valve metal anode to better tolerate the over-polarization which is usually required at the start-up of the cathodic protection system in order to condition the surface of the structure to be protected.

Moreover, the use of dissoluble bushes made of copper or cuprous-nickel alloys provides, through their dissolution, an efficacious source of inhibitory agents, essentially represented by cuprous ions, against the bio-fouling of the surface of the structure to be protected during the initial conditioning of the surface of the structure.

The tooling system which is utilized for the swaging process comprises a split tool body into which is fitted a segmented bored die, which bore's diameter may be varied by suitably substituting the segments constituting the die.

The tool bodies are assembled respectively on the press platen and on the ram of a press.

The press is preferably of the hydraulic type and may have a capacity of about 100 to 200 tons.

The hydraulic system of the press may advantageously be designed to give a fast approach speed at low pressure, followed by a slower high pressure closing rate as the assembly is swaged.

The swaging operation is completed in one stroke by closing the die around the bush on the outside of the tubular valve metal anode.

The method of the present invention may be better illustrated making reference to the series of drawings schematically represented by the attached figures, of which:

Figure 1:
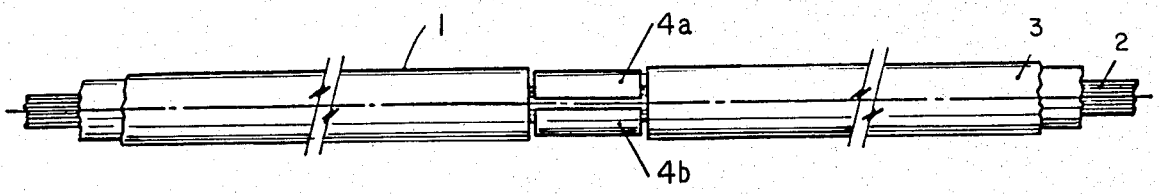
FIG. 1 is a view of a portion of the power supply cable prepared for the connection to an anode.

Making reference to the figures, wherein the same parts are indicated by the same numbers and which scope is simply illustrative and is in no way intended as limitative, FIG. 1 represents a portion of the power supply cable 1, constituted by a conductive core 2 of plaited or stranded copper wires or other highly conducting materials and a sheath 3, made of elastomeric insulating material resistant to the environment of utilization of the anode assemblies.

The cable is prepared for the electrical connection to an anode by stripping the insulating sheath for a segment of about 2 to about 10 cm or more. A split collar, usually composed of two parts 4*a* and 4*b* (or more parts), made of copper or other highly conductive materials and having a thickness similar to the thickness of the insulating sheath 3, is placed around the exposed conductive core of the cable.

Figure 2:
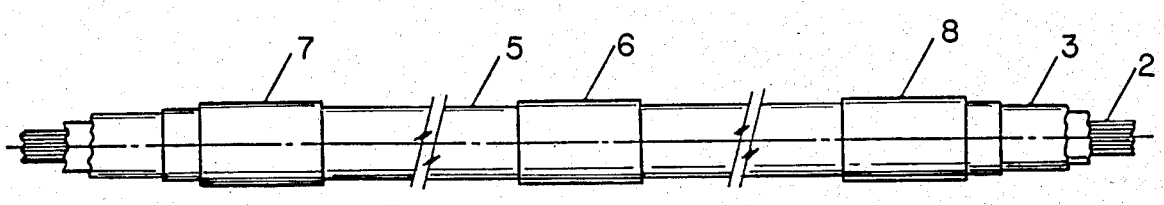
FIG. 2 is a view of a tubular anode inserted onto the cable of FIG. 1.

As illustrated in FIG. 2, the tubular anode 5, preferably constituted by a titanium tube or other valve metal tube, coated on the external surface by a layer of a material resistant to the anodic conditions and non passivatable, is inserted on the cable and slid along it until it is operatively superimposed to the segment of the cable, already prepared for the electrical connection.

Three bushes 6,7 and 8, of iron, for example ARMCO iron, are inserted onto the tubular anode and placed respectively in correspondence of the central portion of the anode (for the electrical connection) and near the two ends of the tubular anode (for the sealing).

Figure 3:
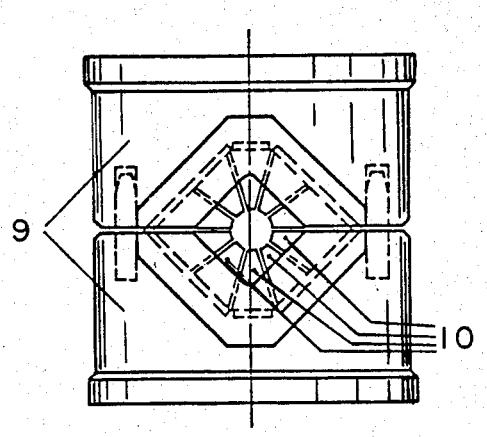
FIG. 3 is a schematic illustration of the swaging die.

The assembly is then laterally inserted inside the split tool body schematically illustrated in FIG. 3, which comprises a split tool body 9, into which is fitted a segmented bored die, consisting of a series of sliding segments indicated generally by the number 10.

The die is schematically illustrated in FIG. 3 in its closed position, that is at the stop limit of the press stroke.

Suitable guide keys are fitted in the lateral portions of the top half of the split tool body to maintain alignment during opening and closing of the die.

Three successive swaging operations are carried out respectively in correspondence of bushes 6, 7 and 8 providing, as previously illustrated, for making the electrical connection and the sealing of the connection with respect to the external environment.

Figure 4:
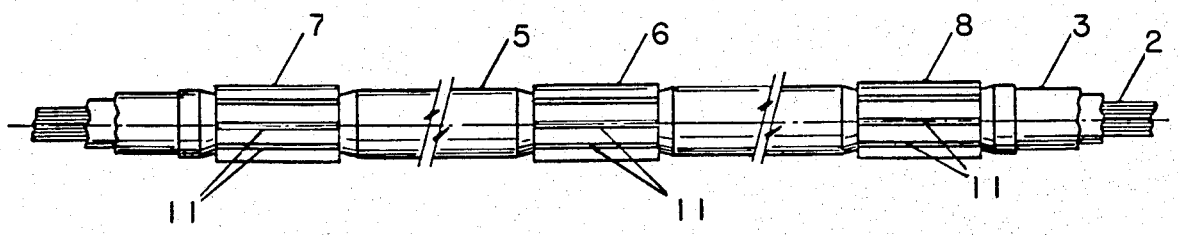
FIG. 4 shows the tubular anode of FIG. 2, after the swaging operation.

FIG. 4 schematically illustrates the anode assembly when the process is terminated.

The mild iron bushes 6, 7 and 8 ductily take up longitudinal wrinkling 11 along their external surfaces.

Figure 5:
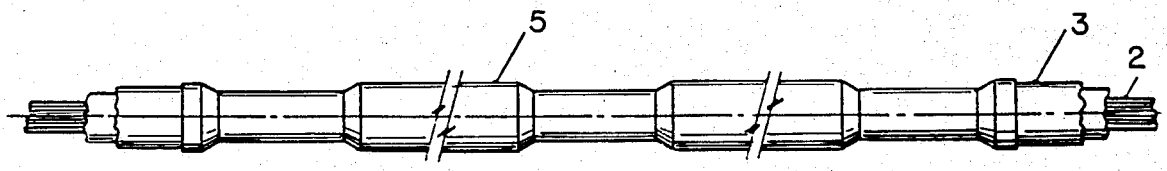
FIG. 5 shows the anode of FIG. 4 after the removal of the bushes used for pressing, or after the anodic dissolution of the same has terminated.

FIG. 5 schematically represents the anode after the removal of bushes 6, 7 and 8 either mechanically or by anodic dissolution after the initial polarization period in the operating environment.

The swaged portions or segments of the titanium or other valve metal anode in correspondence of the central connection and of the sealing at the two ends are substantially cylindrical and free of any wrinkling.

The method of the invention does not resort to any auxiliary means for the sealing of the electrical connection, which is obtained directly between the valve metal tube and the elastomeric insulating sheath of the power supply cable and produces exceptionally good and log lasting connections perfectly protected from corrosion.

Other advantages of the method of the invention are the perfect reproducibility of the quality of the connection, which is quickly completed due to the substantially automatized process, and the reduction of the probabilities of faulty connections or sealings imputable to poor workmanship.

Furthermore, the two sealing swagings effected on the insulated cable at the two ends of the tubular anode improve the sturdiness of the assembly and effectively prevent any direct stress on the electrical connection during transportation, installation and use of the anode assembly.

We claim:

1. The method for making a sealed electrical connection between anodically insoluble tubular valve metal anodes, coated on their external surface with a non-passivatable and corrosion resistant material, to the corrodible core of a power supply cable insulated with a sheath of elastomeric insulating material comprising:

(a) disposing three bushes of ductile metal over the tubular valve metal anode one of which in a substantially central position with respect to the length of the anode and the remaining two near the two ends of the anode respectively;

(b) passing the power supply cable through the tubular anode until a segment of the cable, previously stripped of its insulating sheath and provided with a split collar of highly conductive metal around the conductive core of the cable and having a thickness substantially similar to the thickness of the sheath is underneath the central bush disposed over the anode;

(c) plastically reducing the circumference of the tubular valve metal anode in correspondence of the three externally disposed bushes by cold-heading the valve metal tubular anode respectively around the split collar disposed on the conductive core in correspondence of the central bush and directly around the elastomeric insulating sheath in correspondence of the two bushes near the two ends of the anode.

2. The method of claim 1 wherein the externally disposed bushes of ductile metal are made of an anodically soluble metal chosen from the group comprising copper, aluminum, iron and cuprous-nickle alloys.

* * * * *